US007179144B2

(12) United States Patent
De Baan

(10) Patent No.: US 7,179,144 B2
(45) Date of Patent: Feb. 20, 2007

(54) OFF-SHORE MOORING AND FLUID TRANSFER SYSTEM

(75) Inventor: Jacob De Baan, Maassluis (NL)

(73) Assignee: Bluewater Energy Services BV, Hoofddorp (NL)

( * ) Notice: Subject to any disclaimer, the term of this patent is extended or adjusted under 35 U.S.C. 154(b) by 0 days.

(21) Appl. No.: 10/720,827

(22) Filed: Nov. 24, 2003

(65) Prior Publication Data

US 2004/0115005 A1 Jun. 17, 2004

(30) Foreign Application Priority Data

Dec. 12, 2002 (GB) ..... 0229031.0

(51) Int. Cl.
*B63B 27/34* (2006.01)

(52) U.S. Cl. ..... 441/5; 441/4; 114/230.12

(58) Field of Classification Search ..... 441/3–5; 114/230.1, 230.12, 263; 405/158, 169
See application file for complete search history.

(56) References Cited

U.S. PATENT DOCUMENTS 3,664,286 A * 5/1972 Chaney ..... 114/256
3,969,781 A * 7/1976 Reid, Jr. ..... 441/5
3,984,059 A 10/1976 Davies
4,417,603 A * 11/1983 Argy ..... 138/149
6,390,733 B1 5/2002 Burbage et al.
6,517,290 B1 * 2/2003 Poldervaart ..... 405/224.2
6,637,479 B1 * 10/2003 Eide et al. ..... 141/387
2002/0174662 A1 11/2002 Frimm et al.
2003/0136132 A1 * 7/2003 Harley et al. ..... 62/50.2
2003/0224674 A1 * 12/2003 Perera et al. ..... 441/4
2004/0077234 A1 * 4/2004 Lavagna et al. ..... 441/4

FOREIGN PATENT DOCUMENTS

GB 2056391 * 3/1981
GB 2328197 A 2/1999
WO WO 00/27692 5/2000

* cited by examiner

*Primary Examiner*—Sunil Singh
(74) *Attorney, Agent, or Firm*—Fulwider Patton LLP

(57) ABSTRACT

Apparatus for transferring cryogenic fluid from a first vessel (5) to a second vessel in an offshore environment. The apparatus includes a semi-submersible floating dock with variable buoyancy structure (14, 15) operable to alter the draught of the dock, enabling it to be lowered in the water and raised again to engage the dock with the second vessel. A single point mooring system (3) is attached to the dock. At least one rigid cryogenic pipeline is attached between the first vessel and the dock via flexible connections. A structure (12) for transferring cryogenic fluid from the dock to the second vessel.

10 Claims, 4 Drawing Sheets

POS. 1
POS. 2
A
B
4
7
8
9
10
11
12
13
14
15
16
17
18
23

OFF-SHORE MOORING AND FLUID TRANSFER SYSTEM

FIELD OF THE INVENTION

The present invention relates to a system for transferring fluids, especially cryogenic fluids, to a vessel in an off-shore environment.

BACKGROUND OF THE INVENTION

Such fluid transfer currently requires transport tankers to come into very close proximity to a production barge. This is hazardous due to the nature of the products concerned, such as liquefied natural gas (LNG) and the capital-intensive equipment which must be employed.

SUMMARY OF THE INVENTION

The present invention provides apparatus for transferring cryogenic fluid from a first vessel to a second vessel in an off-shore environment, comprising a partly submerged floating dock, variable buoyancy means operable to alter the draught of the dock to enable engagement of the dock with the second vessel, a single point mooring system attached to the dock, at least one rigid cryogenic pipeline attached between the first vessel and the dock via flexible connection means, and means for transferring cryogenic fluid from the dock to the second vessel.

Thus, the present invention allows a production vessel to provide fluid to a tanker, via rigid cryogenic piping and a floating dock which has an extremely benign response to the environment, i.e. it moves very little in response to wind and wave action. This means that rigid flow lines become feasible in terms of strength and fatigue life. Such rigid pipelines are considerably cheaper than flexible flow lines and require less maintenance and less frequent replacement.

Preferably, there are two or more rigid pipelines between the dock and the first vessel and means enabling a return flow of fluid received at the dock from one pipeline to a second pipeline. This can be used when no second vessel is engaged with the dock and such recirculation of fluid helps to keep the temperature of the fluid down to the required level.

In a preferred embodiment, the single point mooring system comprises a turret rotatably mounted to the dock and anchor lines attached to the turret. The turret may be mounted with its centreline forward of a leading edge of the dock, or rearward of a leading edge by approximately 20 to 50% of the length of the dock.

Preferably, the dock itself comprises a floor structure engagable against the hull of the second vessel and a plurality of columns projecting upwardly from the floor structure, wherein the cross-sectional area of the columns at the waterline is in the region of 20 to 25 $m^2$.

The variable buoyancy means in the dock may comprise ballast compartments extending between the columns above the waterline.

The variable buoyancy means may further comprise ballast compartments located in the floor structure beneath the waterline.

Advantageously, the dock is designed to accommodate tankers having a load capacity in the range from 50,000 to 150,000 $m^3$.

Furthermore, the dock may be provided with a position control system and thrust producing devices, to enable it to be aligned with an approaching tanker for ease of docking.

BRIEF DESCRIPTION OF THE DRAWINGS

The invention will now be described in detail, by way of example, only with reference to the accompanying drawings in which.

DETAILED DESCRIPTION OF THE INVENTION

Figure 1:
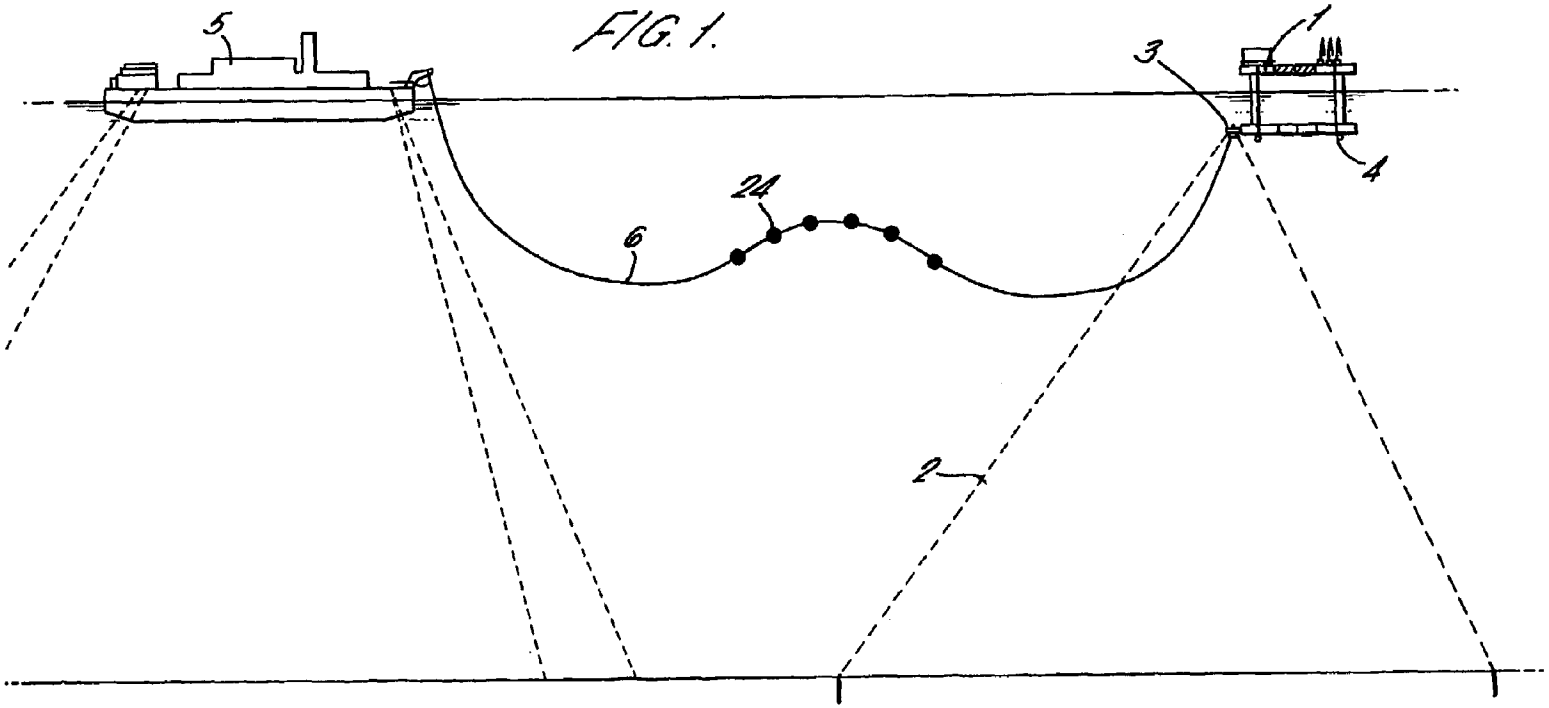
FIG. 1 is a schematic view of the mooring and transfer system in accordance with a first embodiment of the first invention.
Figure 4:
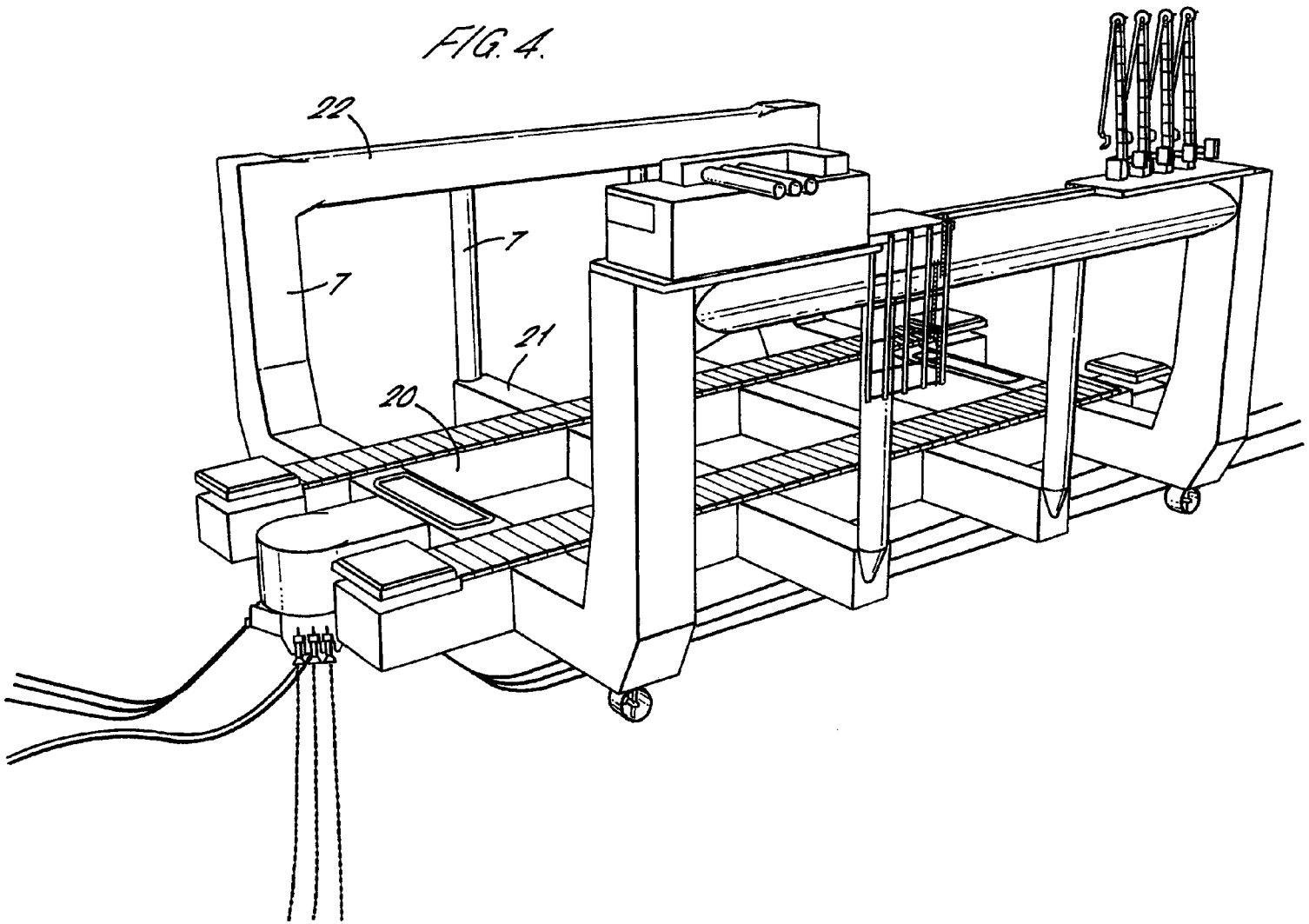
FIG. 4 is a perspective view of the floating pontoon of FIGS. 1 to 3.

A first embodiment of the present invention is illustrated in FIG. 1. The mooring and fluid transfer system includes a floating dock in the form of a pontoon 1 formed by two rows of substantially vertical columns 7 projecting both above and below the water line. Below the water line the two rows are joined by a network of longitudinal and lateral horizontal limbs 20, 21. Above the waterline, the columns 7 in each row are joined by longitudinal limbs 22. This is best seen in FIG. 4. The pontoon 1 is designed to have a small water line area and a relatively high mass.

An anchoring system 2, which allows the pontoon 1 to weathervane around a single point mooring system 3, is attached to the pontoon 1. A position control system with thrust producing devices 4 integrated into the pontoon 1 allows adjustment of the position of the pontoon 1 in the sea against the restoring force of the anchoring system 2. Thus, the position of the pontoon 1 can be altered to assist with alignment with an approaching tanker, so that the tanker can pass between the two rows of columns 7 for docking.

The pontoon 1 is fitted with means to regulate its draught so that it can be raised in the water to dock against the underside of a tanker with excess buoyancy force, such that the horizontal friction between the pontoon 1 and the tanker is sufficient to ensure that both structures move in unison under the effect of sea current and wind forces.

The pontoon 1 is fitted with means to receive cryogenic fluids from a floating production barge 5 moored some distance away, such as around 2000 m. This means comprises of one or more flow lines 6 suspended between the production barge 5 and the pontoon 1. The flow lines 6 may be single or doubled walled steel pipes, with or without insulation material as the need to conserve heat dictates.

Figures 2, 2A, 2B:
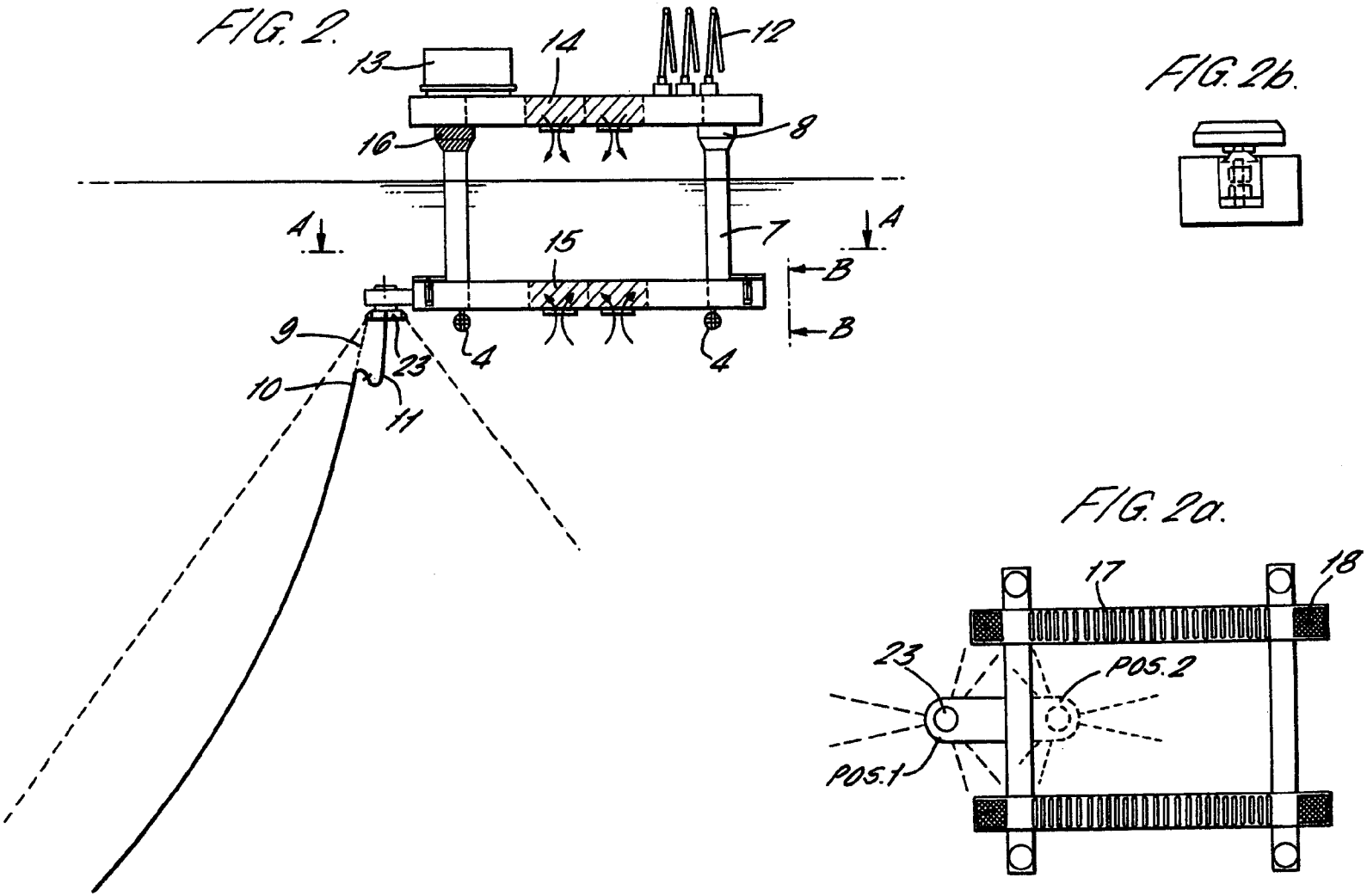
FIG. 2 is a schematic side view of the floating pontoon of FIG. 1.
FIG. 2*a* is a cross-section of FIG. 2 on the line A—A.
FIG. 2*b* is a cross-section of FIG. 2 along the line B—B.

The flow lines 6 are attached to the pontoon 1 by a connecting member 9, best seen in FIG. 2, which may be a chain, wire or a rod. The end 10 of the flow line 6 is connected to a flexible hose 11 which is in turn connected to the single point mooring system 3 to provide a fluid pathway between the flow line 6 and the pontoon 1.

Figure 1A:
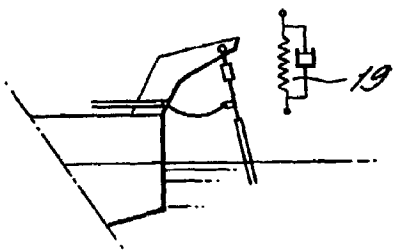
FIG. 1*a* is an enlarged view of the end of the production barge and the attached pipeline as seen in FIG. 1.

As seen in FIG. 1*a*, the connection point of the flow lines 6 to the production barge 5 may include means 19 to support the flow lines 6 in a resilient manner if required due to the combination of outside flow line diameter and wave height/wave climate at the site of operation of the mooring and transfer system. The resilient means 19 may take the form of a piston and cylinder arrangement for example.

As mentioned above, the pontoon comprises a number of substantially vertical columns 7 which have a relatively small water line area, typically 20 to 25 $m^2$, but can have a larger diameter portion 8 as seen in FIG. 2, well above the water line to provide reserve buoyancy.

The pontoon 1 is also fitted with ballast water compartments 14 above the water line in the limbs 22, and sea water inlet tanks 15 below the water line in the limbs 20 to enable the buoyancy of the pontoon to be varied and a quick docking and undocking procedure to a tanker keel to be achieved.

The single point mooring system 3 includes a cryogenic fluid swivel to provide a fluid flow path from hose 11 to the pontoon 1. The pontoon 1 is also fitted with means 12 to connect the pontoon 1 with the manifold of a tanker docked with the pontoon 1. The single point mooring 3 is preferably executed as a so-called turret system, with anchor lines 2 connecting the turret 23 to the sea bed and the turret 23 being rotatably fitted to the pontoon 1. The centreline of the turret may be located at the forward edge of the pontoon 1 as illustrated in FIG. 2*a* in solid lines as position 1. This increases the directional stability of the pontoon 1 in the sea. However, in some situations it may be advantageous to locate the turret 23 at approximately 20 to 50% of the pontoon length behind the forward edge. This is illustrated in dotted lines as position 2 in FIG. 2*a*.

Preferably two flow lines 6 are provided. Each may be of approximately 26" outside diameter and approximately 20" inside diameter, with insulation therebetween, so as to be suitable for carrying cryogenic fluids. The flow lines 6 may include buoyancy aids 24 to support the mid-portion of the flow lines 6. Preferably, when suspended between the pontoon 1 and the barge 5 the flow lines 6 lie at approximately mid depth of the body of water concerned so as to minimize heat influx from warmer surface waters. The fluid in the flow lines 6 can be maintained in a cold condition by re-circulating the fluid through the two flow lines and the piping on the pontoon 1 when there is no tanker docked in the pontoon 1.

The pontoon 1 may be fitted with a power plant 13 intended to drive its propulsion system 4, and a boil-off gas compressor and re-liquification plant for vapor discharged from the tanker when loading cryogenic fluid. This power plant 13 may operate on such vapors or boil-off gas from the flow lines 6 when no tanker is present.

Figure 3:
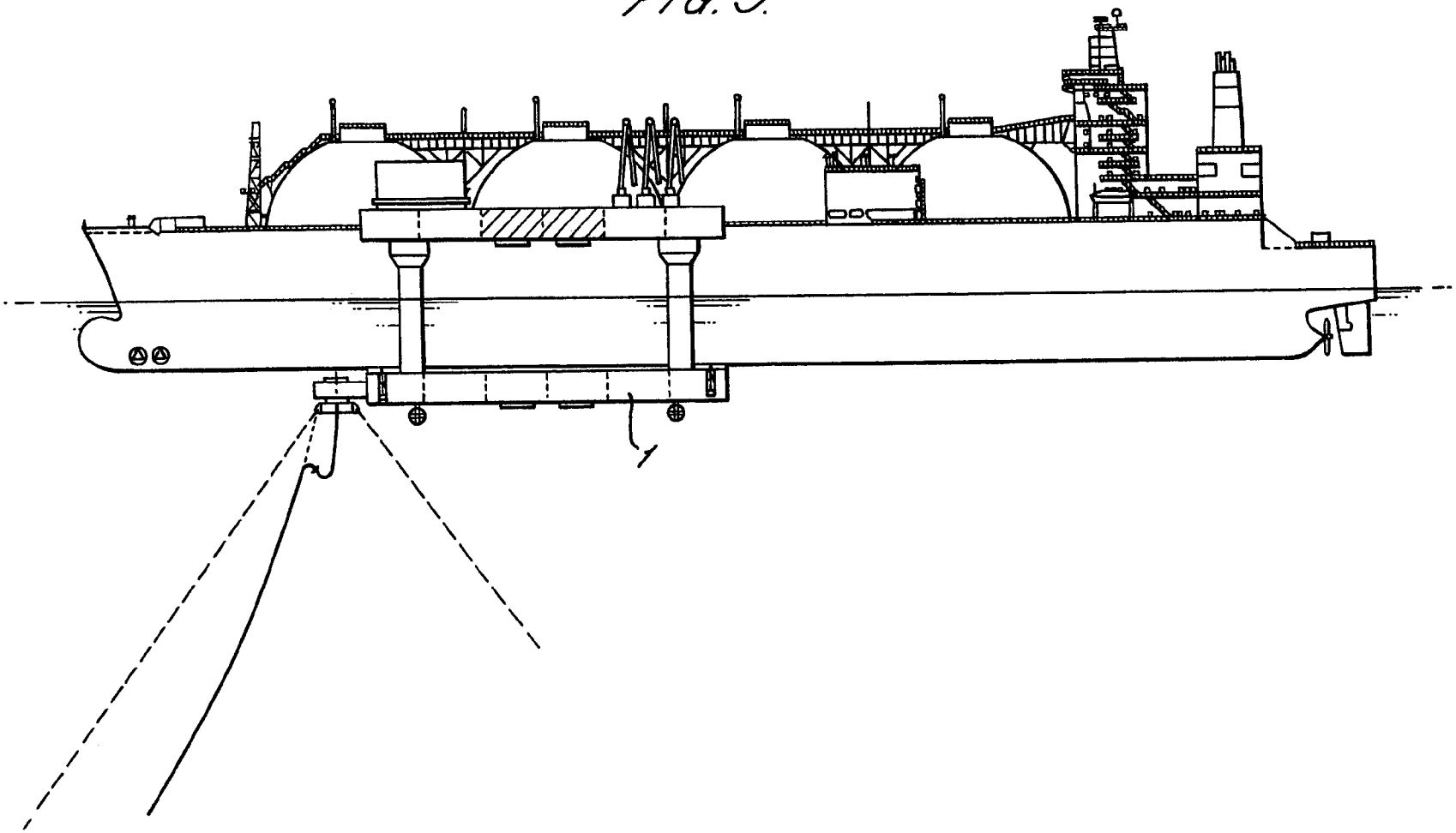
FIG. 3 is a schematic view of the pontoon of FIGS. 1 and 2 engaged with a tanker.

The lay-out of the pontoon 1 is designed such that when a tanker is docked with the pontoon, the turret of the single point mooring system 3 is located in the forward third of the tanker length, and the length of the pontoon 1 is such that it just projects past the tanker's mid-ship manifolds. This is illustrated in FIG. 3.

Preferably, the pontoon 1 consists of four vertical columns 7 on each side spaced approximately 70 meters apart. It can accommodate tankers in the range of 50,000 cubic meters ($m^3$) to 150,000 cubic meters ($m^3$) and the width of the pontoon 1 between opposing columns 7, seen in FIG. 4, does not exceed the width of the tankers to be accommodated. The pontoon is preferably designed to operate in wave heights up to about 4 meters. The subsea horizontal members of the pontoon are provided with suitable resilient means 17 to allow the pontoon 1 to safely engage against the underside of the tanker keel. In addition, a resilient energy absorbing element 18 is placed at the end of each of the longitudinal limbs 20 to absorb differential motions between the tanker and the pontoon 1 during docking.

The invention claimed is:

1. Apparatus for transferring cryogenic fluid from a first floating vessel to a second floating vessel in an off-shore environment, comprising:

a semi-submersible floating dock, variable buoyancy means operable to alter the draught of the dock to enable engagement of the dock with the underside of the keel of the second vessel, a single point mooring system attached to the dock, at least one rigid cryogenic pipeline attached between the first vessel and the dock via flexible connection means, and means for transferring cryogenic fluid from the dock to the second vessel.

2. Apparatus as claimed in claim 1, further comprising two or more rigid pipelines between the dock and the first vessel and means to enable the return of fluid received at the dock from one pipeline to a second pipeline.

3. Apparatus as claimed in claim 1, wherein the single point mooring system comprises a turret rotatably mounted to the dock and anchor lines attached to the turret.

4. Apparatus as claimed in claim 3, wherein the turret is mounted with its centerline forward of a leading edge of the dock.

5. Apparatus as claimed in claim 3, wherein the turret is mounted with its centerline rearward of a leading edge of the dock by approximately 20 to 50% of the length of the dock.

6. Apparatus as claimed in claim 1, wherein the dock comprises a floor structure engageable against the hull of the second vessel and a plurality of columns projecting upwardly from the floor structure, wherein the cross-sectional area of the columns at the water line is in the region of 20 to 25 $m^2$.

7. Apparatus as claimed in claim 6, wherein the variable buoyancy means comprises ballast compartments extending between the columns above the water line.

8. Apparatus as claimed in claim 6, wherein the variable buoyancy means further comprises ballast compartments located in the floor structure beneath the water line.

9. Apparatus as claimed in claim 1, wherein the dock is designed to accommodate tankers in the range from 50,000 $m^3$ to 150,000 $m^3$.

10. Apparatus as claimed in claim 1, wherein the dock further comprises a position control system and thrust producing devices.

* * * * *